US006910900B2

(12) United States Patent
Pan

(10) Patent No.: US 6,910,900 B2
(45) Date of Patent: Jun. 28, 2005

(54) GROUNDED ELECTRICAL CONNECTOR

(75) Inventor: Wei-Hua Pan, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/930,137

(22) Filed: Aug. 30, 2004

(65) Prior Publication Data

US 2005/0048818 A1 Mar. 3, 2005

(30) Foreign Application Priority Data

Aug. 30, 2003 (CN) ..... 03278273 U

(51) Int. Cl.[7] ..... H01R 13/648
(52) U.S. Cl. ..... 439/108; 439/74; 439/607
(58) Field of Search ..... 439/108, 607, 439/74

(56) References Cited

U.S. PATENT DOCUMENTS 5,915,976 A 6/1999 McHugh
6,033,236 A 3/2000 McHugh et al.
6,159,021 A * 12/2000 Kusuhara ..... 439/74
6,250,935 B1 * 6/2001 Mochizuki et al. ..... 439/74
6,464,515 B1 * 10/2002 Wu ..... 439/108
6,726,492 B1 * 4/2004 Yu ..... 439/108

* cited by examiner

*Primary Examiner*—Tho D. Ta
(74) *Attorney, Agent, or Firm*—Wei Te Chung

(57) ABSTRACT

An electrical connector includes a dielectric housing defining a mating space with a pair of two opposite side wall by two sides thereof, a plurality of passageways formed in an inner face of each of the side walls, a number of signal and grounding terminals received in corresponding passageways, respectively, a shielding member attached to the side walls and a grounding member. Each grounding member includes an intermediate portion and three spaced beams extending from a side of the intermediate portion along a same direction. A middle one of the three beams is snugly retained in corresponding channel. The other two beams electrically and mechanically press the grounding terminal and the shield plate against the side wall, respectively.

4 Claims, 4 Drawing Sheets

GROUNDED ELECTRICAL CONNECTOR

CROSS-REFERENCE TO RELATED APPLICATIONS

Relevant subject matter is disclosed in a pending U.S. patent application Ser. No. 10/452,159, filed on May 30, 2003 and entitled "GROUNDED ELECTRICAL CONNECTOR", which is invented by the same inventor as this patent application and assigned to the same assignee with this application.

BACKGROUND OF THE INVENTION

1. Field of the Invention

The present invention relates to an electrical connector, and particularly to a board-to-board connector with reliable grounding means.

2. Description of Related Art

Board-to-Board connector assembly generally includes a plug and a receptacle connectors respectively mounted on two parallelly spaced printed circuit boards (PCB) and mated with each other for mechanical and electrical interconnection therebetween, whereby the corresponding printed circuit boards can be electrically connected with each other for signal transmission.

A conventional board-to-board connector assembly can be referred to U.S. Pat. No. 5,915,976 which discloses a plug and a corresponding receptacle connector. The receptacle connector includes a housing, a number of contacts disposed in inner opposite sides of the insulative housing, and a pair of shielding plates positioned on outer opposite sides of the insulative housing. Each shielding plate has a number of hooks extending from a bottom end thereof. The hooks extend into the insulative housing and contact with predetermined contacts for forming a grounding path to filter noises and EMI (electromagnetic interference).

With high speed and high frequency signals transmitting in the board-to-board connector assembly, contacts of the connector assembly generate much more quantity of heat comparing with low speed and low frequency signals transmission. However, there is no enough room inside the mated connector assembly for meeting the requirements of heat dissipation. Thus, an appropriate approach is to increase the height of the receptacle connector to provide additional room. Accordingly, the shielding plate and the contacts has to be heightened to match the heightened receptacle connector. Whereas, such heightened shielding plate and contacts are readily warped during assembly and transportation of the connector, which will cause the contact between the hooks of the shielding plate and the predetermined contacts unstable or even break away, thereby degrading the effect of filtering EMI and resulting in poor transmission of signals.

Hence, an improved board-to-board connector is desired to overcome the disadvantage of the prior art.

SUMMARY OF THE INVENTION

An object of the present invention is to provide an electrical connector having a stable and reliable grounding means for filtering noises and EMI.

To achieve the above object, an electrical connector comprises a dielectric housing, a plurality of signal terminals and grounding terminals, a shielding member and a grounding member. The dielectric housing comprises a mating surface, a mounting surface, a pair of side walls extending between the mating surface and the mounting surface and a mating space in the mating face between the side walls. Each side wall defines a plurality of passageways in an inner face thereof and a plurality of channels in the mounting face. The signal and grounding terminals are received in corresponding passageways, respectively. The shielding member is attached to outer faces of the side walls. Each grounding member comprises an intermediate portion and three spaced beams extending from one side of the intermediate portion along a same direction. A middle one of the three beams is snugly retained in corresponding channel. The other two beams electrically and mechanically presses the grounding terminal and the shield plate against the side walls, respectively.

Other objects, advantages and novel features of the invention will become more apparent from the following detailed description when taken in conjunction with the accompanying drawings.

DETAILED DESCRIPTION OF THE PREFERRED EMBODIMENT

Figure 1:
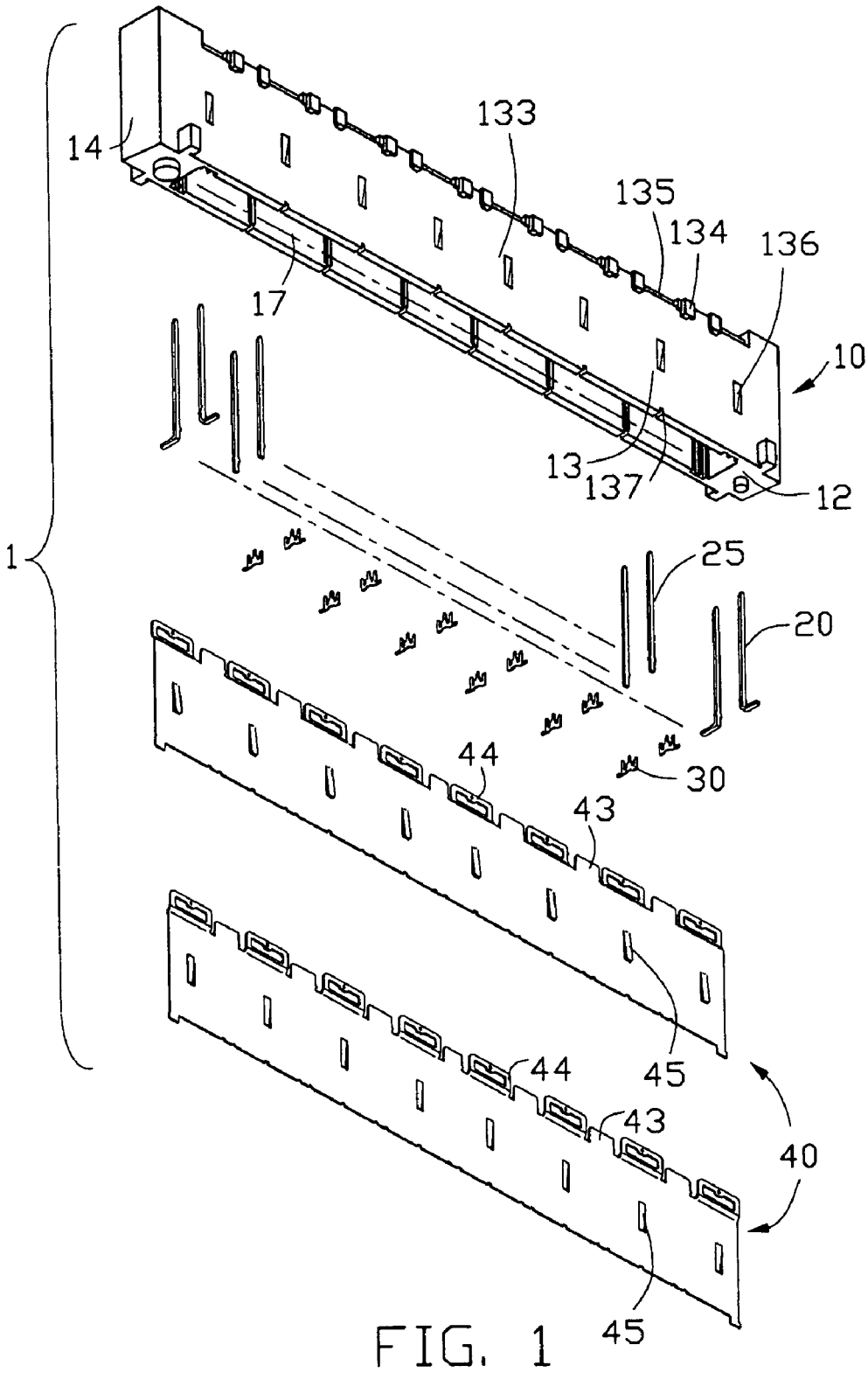
FIG. 1 is an exploded perspective view of an electrical connector in accordance with the present invention.
Figure 2:
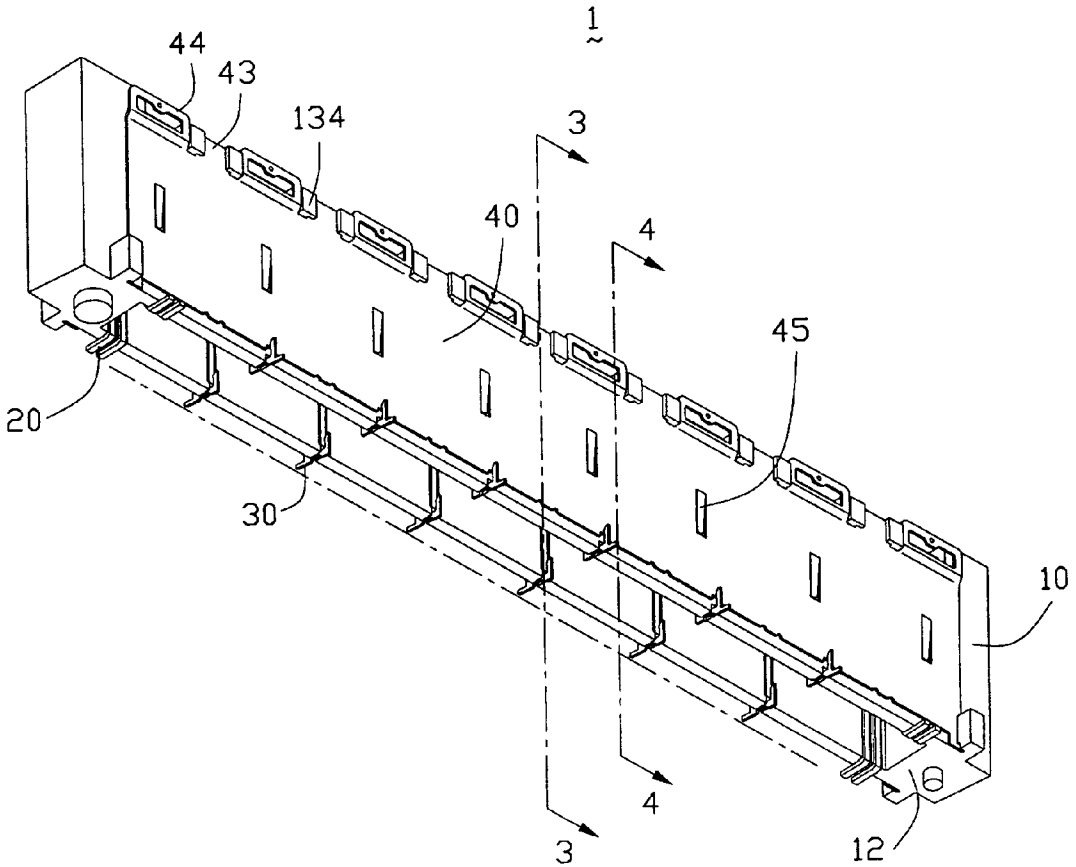
FIG. 2 is an assembled perspective view of the connector shown in FIG. 1.

Referring to FIGS. 1 and 2, an electrical connector 1 in accordance with the present invention comprises an elongate dielectric housing 10, a plurality of signal terminals 20 and grounding terminals 25 received in the dielectric housing 10, respectively, a shielding member 40 attached to the dielectric housing 10 and a plurality of grounding members 30.

Figure 3:
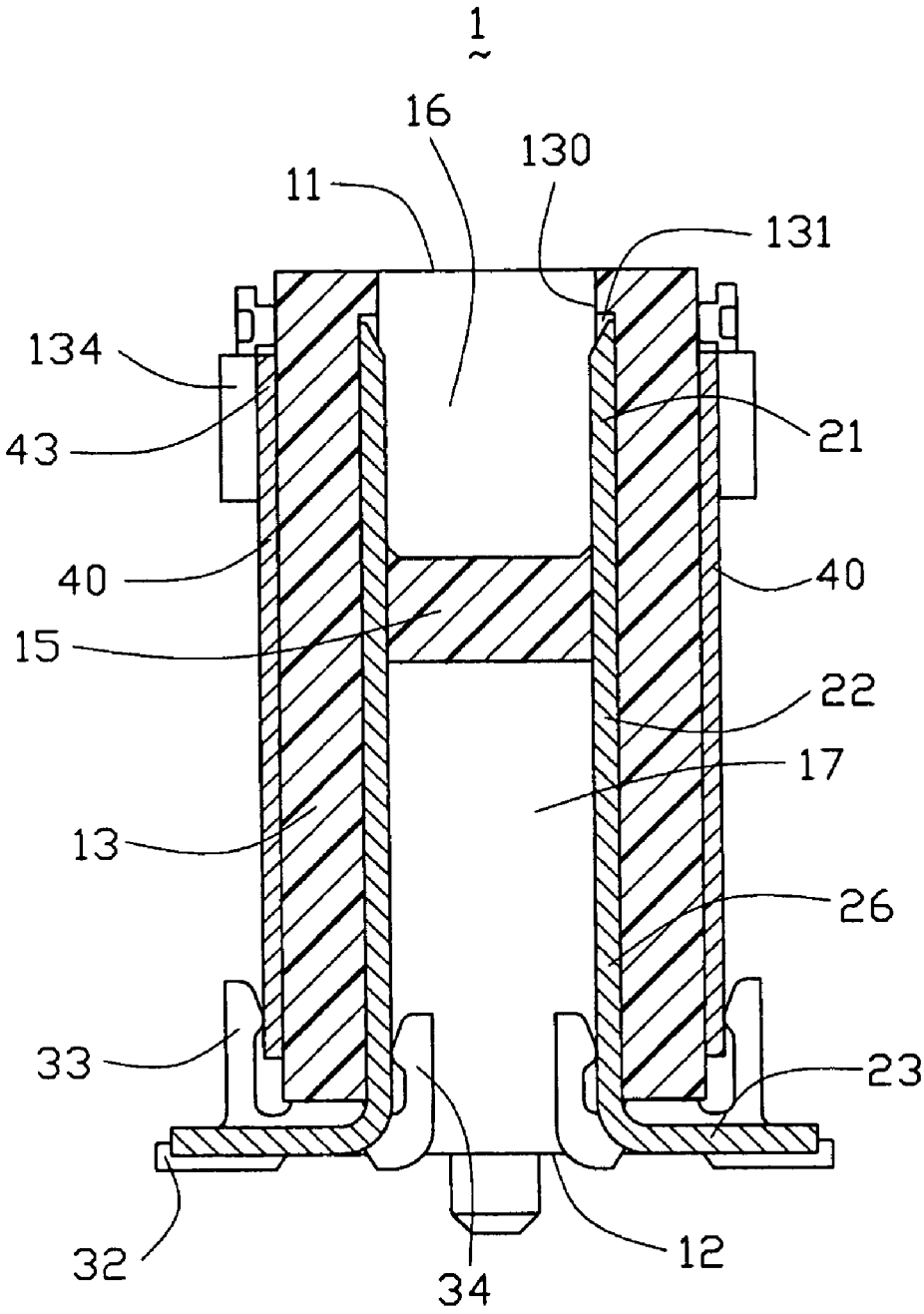
FIG. 3 is a cross-sectional view of the connector taken along line 3—3 of FIG. 2.
Figure 4:
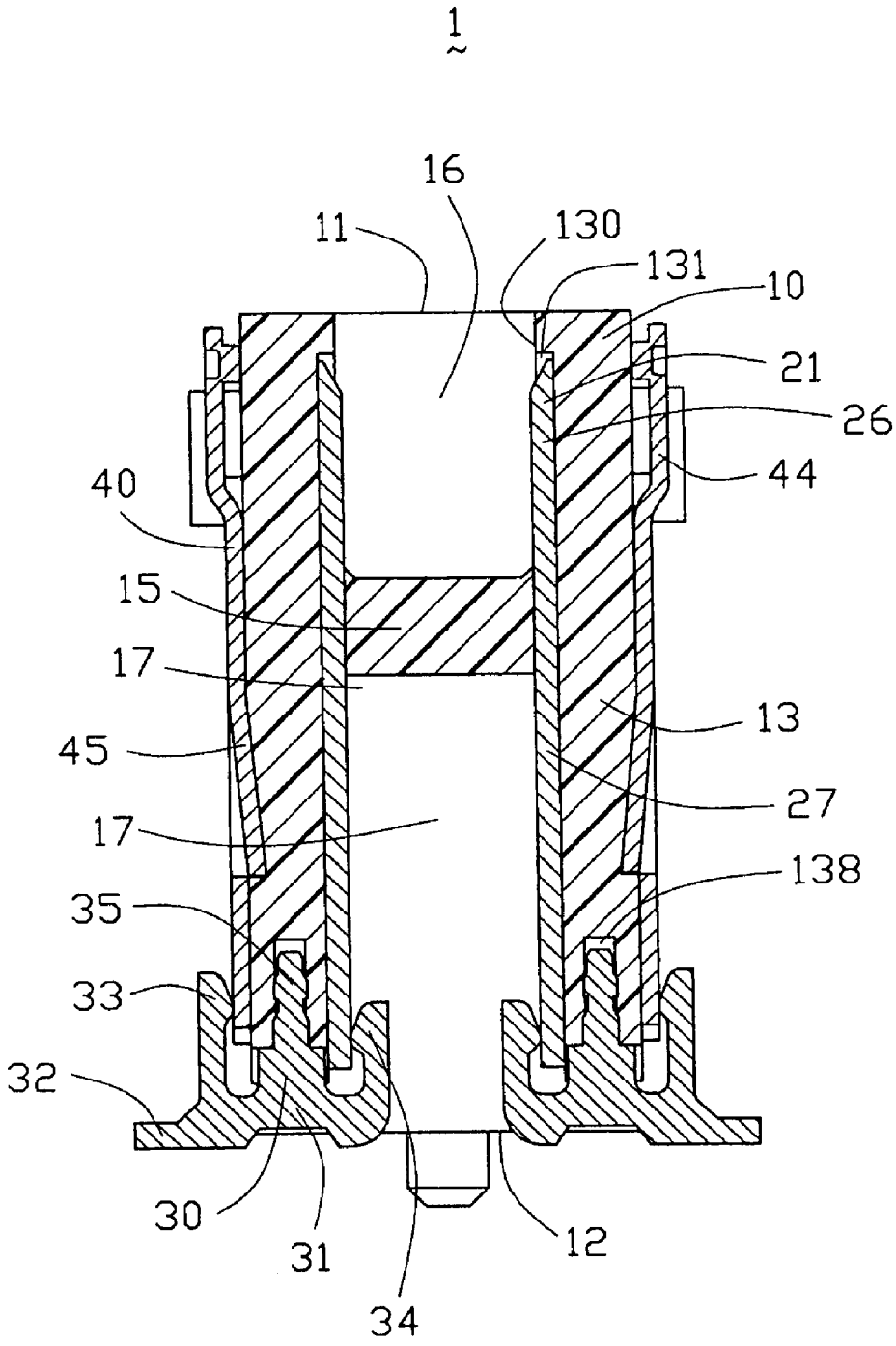
FIG. 4 is a cross-sectional view of the connector taken along line 4—4 of FIG. 2.

Referring to FIGS. 1 and 3, the dielectric housing 10 has a mating surface 11 and a mounting surface 12 opposite to the mating surface 11. Laterally spaced opposite side walls 13 and longitudinally spaced opposite end walls 14 extend between the mating surface 11 and the mounting surface 12, respectively. The dielectric housing 10 defines a mating space 16 in the mating surface 11 between the side walls 13 and a cavity 17 in the mounting surface 12 between the side walls 13. A clapboard 15 is formed between the mating space 16 and the cavity 17 and interconnects with the side walls 13 and the end walls 14. Each side wall 13 defines a plurality of passageways 131 in an inner face 130 thereof. Each passageway 131 communicates with the mating space 16 and the cavity 17 and passes through a joint of the side wall 13 and the clapboard 15. The side wall 13 has a plurality of pairs of protrusions 134, a plurality of cutouts 135 alternatively arranged with the pair of protrusions 134 along a lengthwise direction thereof and a plurality of recesses 136 located below the protrusions 134 and the cutouts 135 on an outer face 133 thereof. As best shown in FIGS. 1 and 4, each side wall defines a plurality of notches 137 aligned with corresponding predetermined passageways 131 in the mounting surface 12 and a plurality of channels 138 recessed toward the mating surface 11 from corresponding notches 137.

Referring to FIGS. 3 and 4, each signal terminal 20 is received in corresponding passageways 131 and comprises a contact portion 21 exposed into the mating space 16, a retaining portion 22 retained in the passageway 131 and exposed into the cavity 17 and a solder portion 23 perpendicularly extending from the retaining portion 22 for being surface mounted onto a printed circuit board (not shown). Each grounding terminal 25 is received in predetermined passageways 131 and comprises a contact portion 26 exposed into the mating space 16 and a tail portion 27 exposed into the cavity 17.

The shield member 40 comprises a pair of shield plates respectively attached to the outer faces 133 of the side walls 13 for shielding purpose. Each shield plate comprises a plurality of retention blades 43 extending from an upper edge thereof for cooperating with corresponding pairs of protrusions 134 of the side wall 13 and a plurality of spring tangs 45 stamped therefrom for being received in a corresponding recess 136 to secure the shield plate to the dielectric housing 10. The shield plate 40 further comprises a plurality of grounding tangs 44 each positioned between every adjacent two retention blades 43 for facing to a corresponding cutout 135 which is adapted to receive a grounding contact of a complementary connector (not shown).

Referring to FIG. 4, each grounding member 30 is stamped from a metal sheet and comprises an approximately horizontal intermediate portion 31, three substantially parallel beams perpendicularly extending from one side of the intermediate portion along a same direction and spaced from one another, and a soldering portion 32 horizontally extending from the intermediate portion 31 for being surface mounted onto the printed circuit board. One of the three beams electrically contacting with the shield plate is a shield contact portion 33. The other of the three beams electrically contacting with the grounding terminal 30 is a terminals contact portion 34. Another of the three beams between the terminal contact portion and the shield contact portion is a retaining portion 35. The grounding member 30 is assembled to the housing 10 with the intermediate portion 31 received in the notch 137 and the retaining portion 35 retained in the channel 138. The shield contact portion 33 tightly presses a bottom edge of the shield plate toward the retaining portion 35 and the terminal contact portion 34 tightly presses the tail portion 27 of the grounding terminal 25 toward the retaining portion 35, thereby preventing the shield plate and the grounding terminal 30 from warpage and securing the shield plate to the dielectric housing 10. At the same time, an efficient protection of EMI is established reliably.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric housing comprising a mating surface, a mounting surface opposite to the mating surface, a pair of side walls extending between the mating surface and the mounting surface and a mating space in the mating face between the side walls, each side wall defining a plurality of passageways in an inner face thereof and a plurality of channels in the mounting face;

a plurality of signal and grounding terminals received in the passageways, respectively;

a shielding member comprises a pair of shield plates respectively attached to outer faces of the side walls; and a plurality of grounding members each comprising an intermediate portion and three spaced beams extending from one side of the intermediate portion along a same direction, a middle one of the three beams snugly retained in a corresponding channel, the other two beams electrically and mechanically pressing the grounding terminal and the shield plate against the side wall, respectively.

2. The electrical connector as claimed in claim 1, wherein each side wall defines a plurality of notches communicating with corresponding channels and receiving corresponding intermediate portions of the grounding members.

3. The electrical connector as claimed in claim 1, wherein the three beams are substantially parallel to each other and perpendicularly extend from the intermediate portion.

4. The electrical connector as claimed in claim 1, wherein each grounding member further comprises a soldering portion extending horizontally from the intermediate portion for being connected to a printed circuit board.

* * * * *